US006177621B1

(12) United States Patent
Hoshino

(10) Patent No.: US 6,177,621 B1
(45) Date of Patent: Jan. 23, 2001

(54) INSTALLATION STRUCTURE OF HIGH HAT CYMBAL

(75) Inventor: Yoshihiro Hoshino, Nagoya (JP)

(73) Assignee: Hoshino Gakki Co., Ltd. (JP)

( * ) Notice: Under 35 U.S.C. 154(b), the term of this patent shall be extended for 0 days.

(21) Appl. No.: 09/478,763

(22) Filed: Jan. 6, 2000

(30) Foreign Application Priority Data

Feb. 19, 1999 (JP) ..... 11-000785

(51) Int. Cl.[7] ..... G10D 13/02

(52) U.S. Cl. ..... 84/422.3; 84/422.1; 84/422.2; 84/421

(58) Field of Search ..... 84/422.3, 422.1, 84/422.2, 421, 453

(56) References Cited

U.S. PATENT DOCUMENTS 4,928,567 * 5/1990 Kurosaki ..... 84/422.3
5,140,883 * 8/1992 Fay ..... 84/266
5,218,151 6/1993 Kurosaki ..... 84/422.3
5,808,217 * 9/1998 Liao ..... 84/422.3
6,054,645 * 4/2000 Gauger ..... 84/422.3

OTHER PUBLICATIONS

Japanese Utility Model Publication Hei 3 39834.
Japanese Utility Model Registration No. 2551692.

* cited by examiner

*Primary Examiner*—Robert E. Nappi
*Assistant Examiner*—Shih-yung Hsieh
(74) *Attorney, Agent, or Firm*—Ostrolenk, Faber, Gerb & Soffen, LLP

(57) ABSTRACT

An installation structure for a high hat cymbal having upper and lower cymbals which are held compressed against each other. A respective elastic member is disposed above the upper cymbal and below the lower cymbal. A pressure applying device applies differential pressure on the elastic member of the upper cymbal for adjusting the compression of the cymbals together. The pressure applying device includes a pivotable plate having edge regions at different radii from the transverse pivot axis of the plate, and a functional member that is pressed upon by the selected edge region of the pivotable plate selectively adjusts the force applied to the elastic members. The various members holding the cymbals, the elastic members and the pressure applying device on the installation rod are disclosed.

8 Claims, 7 Drawing Sheets

INSTALLATION STRUCTURE OF HIGH HAT CYMBAL

BACKGROUND OF THE INVENTION

The invention relates to an installation structure for a high hat cymbal wherein the lower and upper cymbals are installed in a state of adhesion without the high hat cymbal being equipped with a pedal.

High hat cymbals can be classified into those in which the upper cymbal and the lower cymbal perform by being moved together or apart through pedal operation and others which perform through stick-beating on the upper cymbal. In the latter case, the lower and upper cymbals are installed in a state of adhesion (closed state) or in a separated state (open state) on the installation rod without being equipped with a pedal to move the cymbals together or apart.

High hat cymbals which are operated by stick-beating are described in the Official Publication of Japanese Utility Model Publication No. Hei 3-39834 and in Japanese Utility Model Registration No. 2551692, to cite two examples.

Utility Model Publication No. Hei 3-39834 discloses a structure in which a lower cymbal receiving member is provided on the lower side of a shaft, which shaft is supported by a prop, an upper cymbal receiving part is installed on the side of the upper edge of the shaft in such a manner as to freely move up and down, and a spring that presses the upper cymbal receiving member upward is provided on the lower side of the upper cymbal receiving member. A nut with a handle is screwed to a spiral part that has been provided toward the upper end of the shaft to push down on the upper cymbal receiving member. The nut is above the upper cymbal receiving member. It is possible to adjust the distance between the upper cymbal and the lower cymbal by moving the upper cymbal up and down through rotating the nut by its handle.

In addition, Utility Model Registration No. 2551692 describes a structure in which an adjusting screw with a spiral formed on its outer periphery is linked to the lower end of a support rod inside of the main holder in the state of the axial line being aligned with the support rod. A screw is screwed into the adjusting screw of the support rod that has been inserted into the main holder body and the screw is formed at the middle of the main holder. A distance adjusting member moves the support rod through the adjusting screw by its own rotation being arranged freely rotatably, and a strengthening member that pushes the support rod upwardly through a bush that has been arranged at the lower part of said support rod is provided toward the lower end of the support rod. This makes it possible to move the adjusting screw that is screwed to the screw part of the distance adjusting member and the support rod that is linked to the adjusting screw by rotating the distance adjusting member, which adjusts the distance between the upper cymbal and the lower cymbal.

The high hat cymbals described in the two examples above enable setting cymbals over a wide range from the open state (the state in which the upper cymbal and the lower cymbal are separated) to the closed state (the state in which the upper cymbal and the lower cymbal are set together). The tone color (tone quality) can therefore be changed during a performance after the installation. Nevertheless, a problem with these high hat cymbals is that their structure becomes complicated with a consequent rise in the manufacturing costs.

Under the circumstances, a high hat cymbal which is shown in FIG. 6, with the cross section of its essential part being shown in FIG. 7., has been proposed recently.

This high hat cymbal comprises the following elements. The installation rod 71 of the cymbal stand 70 is inserted through a lower cymbal fixing member 81 and the member 81 is fixed at a desired location along the rod 71. A lower cymbal receiving member 82 is placed on the lower cymbal fixing member 81 and the member 82 is inserted into the installation hole 73 of the lower cymbal 72. The installation rod 71 is also inserted through that hole. A lower elastic member 83 is interposed between the lower cymbal 72 and the lower cymbal receiving member 82. An upper cymbal holding member 84 is inserted into the installation hole 75 of the upper cymbal 74 and the installation rod 71 is inserted through that hole. An upper cymbal fixing member 85 is fixed to the installation rod 71 to press against the upper surface of the upper cymbal holding member 84. An upper elastic member 86 is interposed between the upper cymbal 74 and the upper cymbal holding member 84.

There is a main pipe 76 of the cymbal stand 70, and the pipe is supported by legs 77. A holding rod 78 extends through link 79 and has the purpose of linking the main pipe body 76 and the holding rod 78. An angle adjusting member 80 links the holding rod 78 and the installation rod 71 to make it possible for the angle to be adjusted.

A further cymbal 90 is provided in addition to the two cymbals 72 and 74 shown.

This high hat cymbal has an extremely simple installation structure and its manufacturing cost can be drastically reduced. However, the lower cymbal 72 and the upper cymbal 74 are held between the lower cymbal fixing member 81 and the upper cymbal fixing member 85 and particularly between the lower elastic member 83 and the upper elastic member 86. As a result, the two cymbals 72 and 74 are continuously pushed together after their installation with a certain compressive force. It becomes impossible to change the tone color with the high hat cymbals in the two examples explained above, thereby narrowing the tonal breadth of a performance.

SUMMARY OF THE INVENTION

The present invention seeks to overcome the above described circumstances by providing the installation structure of a high hat cymbal which is capable of easily changing its tone color during a performance by using a simple structure.

In the invention, the installation structure of a high hat cymbal includes a lower cymbal and an upper cymbal, which are installed in a state of adhesion, with adjustable, different compressive forces, on the installation rod of the cymbal stand. A lower cymbal fixing member through which the installation rod is inserted is fixed at a desired location on the rod. A lower cymbal receiving member is inserted into the installation hole of the lower cymbal and is placed on the lower cymbal fixing member as the installation rod is being inserted. A lower elastic member is interposed between the lower cymbal and the lower cymbal receiving member. An upper cymbal fixing adjustment member comprises an upper cymbal fixing part through which the installation rod is installed and that part is fixed at the position where the upper cymbal and the lower cymbal are joined together. A compressive force adjusting part is supported to the upper cymbal fixing part at a horizontal axle that is transverse to the rod. The fixing part has a plurality of compressing surfaces at different edge regions, which are at different distances or radii from the axle. An operating lever is formed integrally with the compressive force adjusting part. A functional member is arranged on the lower side of the upper cymbal fixing adjustment member and therefore receives the compressive force of the compressive part. An upper cymbal holding member is inserted into the installation hole of the upper cymbal and is arranged below the functional member when the installation rod is inserted. An upper elastic member is interposed between the upper cymbal and said upper cymbal holding member.

Other objects and features of the invention are explained below with reference to the attached drawings.

DESCRIPTION OF A PREFERRED EMBODIMENT

Figure 1:
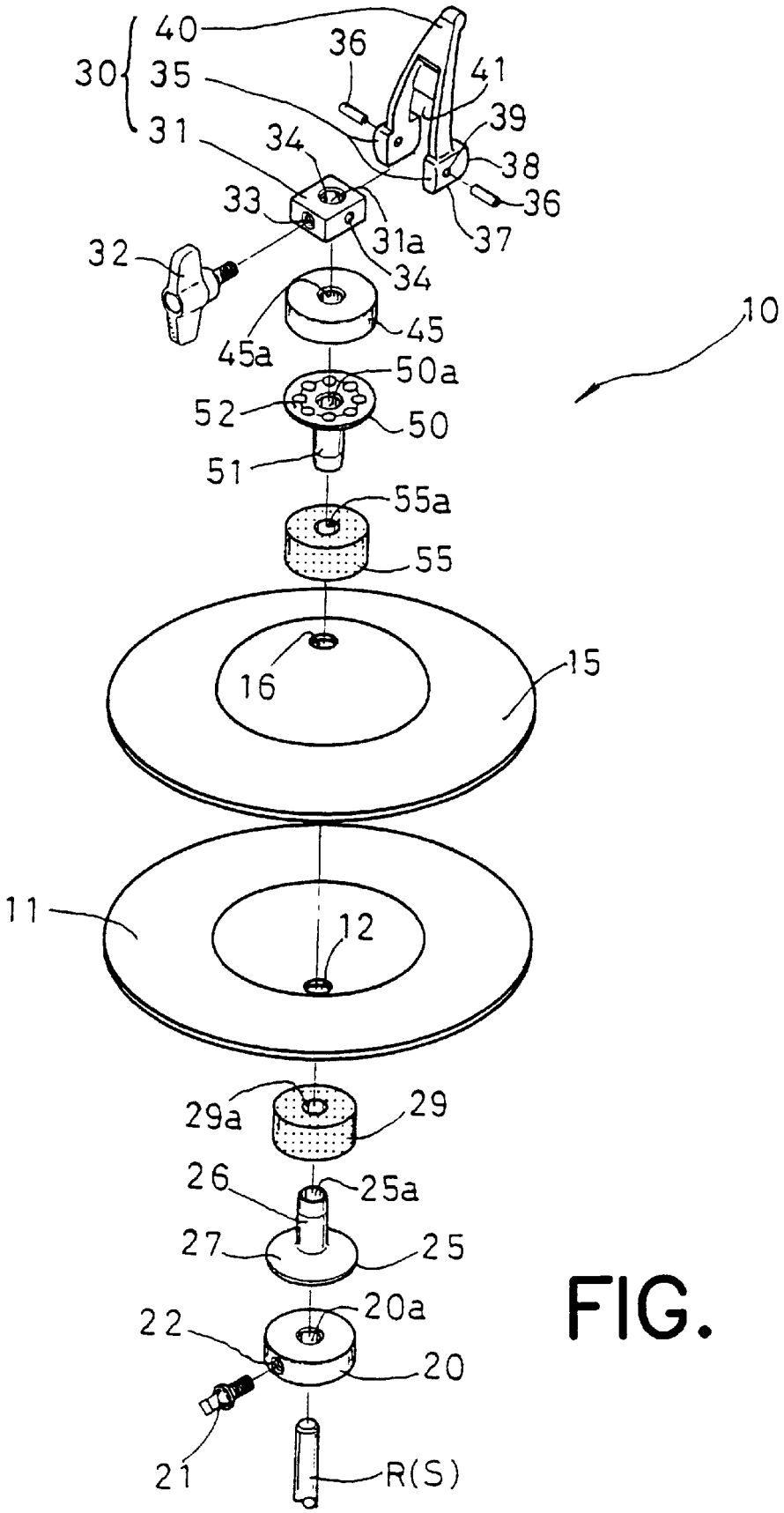
FIG. 1 is an oblique and exploded view of an essential part of a high hat cymbal according to the invention.
Figure 2:
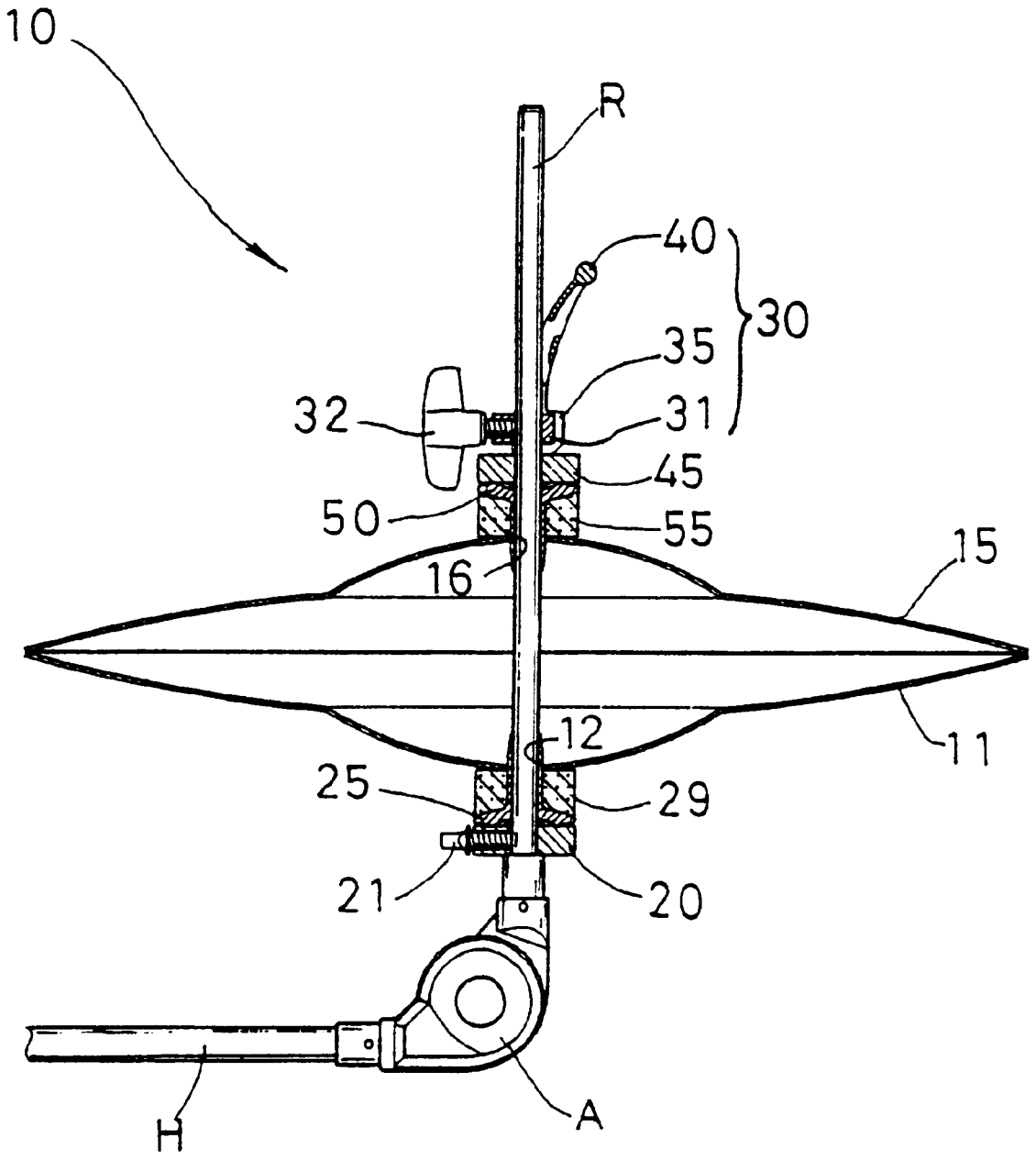
FIG. 2 is a partial cross section of the cymbal of FIG. 1.

FIGS. 1 and 2 show a cymbal installation 10 which is an essential part of a high hat cymbal of the invention. This cymbal installation 10 has the purpose of connecting a lower cymbal 11 and an upper cymbal 15 to an installation rod R of a cymbal stand S under different compressive forces on the cymbals. The installation 10 comprises a lower cymbal fixing member 20, a lower cymbal receiving member 25 above the lower cymbal fixing member 20 and resting on it, a lower elastic member 29 above the receiving member 25 and pressed upon by the member 25, an upper cymbal fixing adjustment assembly 30, a functional member 45 below the assembly 30, an upper cymbal holding member 50 below the member 45 and an upper elastic member 55 pressed upon by the member 50.

The cymbal stand S includes a holding rod H. An angle adjustment hinge A links the holding rod H and the installation rod R so as to make it possible to adjust their relative angle.

The lower cymbal fixing member 20 is for positioning the lower cymbal receiving member 25 and, in turn, to position the lower cymbal 11 along the installation rod R. As the installation rod R is inserted through the above noted elements, the desired positions of those elements along the rod are fixed. The lower cymbal fixing member 20 is comprised of a tubular body or a disc having an aperture 20*a* for receiving the inserted rod R and the installation rod R is inserted through the aperture 20*a*, where it is fixed by tightening a fixing screw 21.

A screw hole 22 for receiving the fixing screw 21 runs radially from the periphery of the lower cymbal fixing member 20 to the aperture 20*a*.

The lower cymbal receiving member 25 with a tubular opening 25*a* has a purpose of holding the lower cymbal 11 on the installation rod R by receiving the lower cymbal 11. The member 25 is placed on the lower cymbal fixing member 20, while the member 25 is inserted into the installation hole of the lower cymbal 11 when the installation rod R is inserted.

The lower cymbal receiving member 25 is integrally comprised of an upstanding tubular part 26 and annular flange 27, wherein the flange 27 contacts the upper surface of the lower cymbal fixing member 20.

The tubular part 26 is inserted into the installation hole 12 of the lower cymbal 11 as described above, which provides an advantage of preventing deterioration of the installation hole 12 caused by the repeated sliding of the lower cymbal 11 along the installation rod R.

A lower elastic member 29 has the purpose of buffering the compressive force from the lower cymbal receiving member 25, and transmitting that force to the lower cymbal 11. The member 29 is interposed between the lower cymbal 11 and the lower cymbal receiving member 25. Felt is illustrated as the lower elastic member 29 in this example. However, the member 29 is not limited to this material, as rubber, foam or some other material having elasticity, such as a spring, etc., can be used as the lower elastic member 29.

The upper cymbal fixing adjustment device 30 positions the functioning member 45 and the upper cymbal holding member 50 and thereby positions the upper cymbal 15 with respect to the installation rod R. The device 30 comprises an upper cymbal fixing part 31, a compressive force adjusting part 35 and an operating lever 40.

The upper cymbal fixing part 31 sets the height position of axles 36, described below. As the installation rod R is inserted, it is fixed at the position where the upper cymbal 15 and the lower cymbal 11 are joined. In this example, the upper cymbal fixing part 31 is a rectangular parallelepiped which has an opening 31 a for receiving the inserted installation rod R. As the installation rod R is inserted through the opening 31*a,* it is fixed in the part 31 by a fixing screw 32. Axle holes 34 for the two axles 36 are formed in a pair of opposite surfaces (the front and the back in the drawing) of the upper cymbal fixing part 3 1.

The part 31 includes a screw hole 33 for receiving the fixing screw 32. The hole 33 is formed through a side of the part 31 such that the hole 33 crosses the pair of surfaces having the axle holes 34 and extends into the opening 31 a of the upper cymbal fixing part 31.

The compressive force adjusting part 35 adjusts the compressive force against the upper cymbal 15 by moving the operating member 45 up and down. The adjusting part 35 is supported on the upper cymbal fixing part 31 through the axles 36. The compressive force adjusting part 35 comprises a pair of plate-like bodies arranged to sandwich the surfaces (the front and the back in the drawing) having the axle holes 34 of the upper cymbal fixing part 31 and these bodies are supported at the holes by the axles 36.

Figure 3:
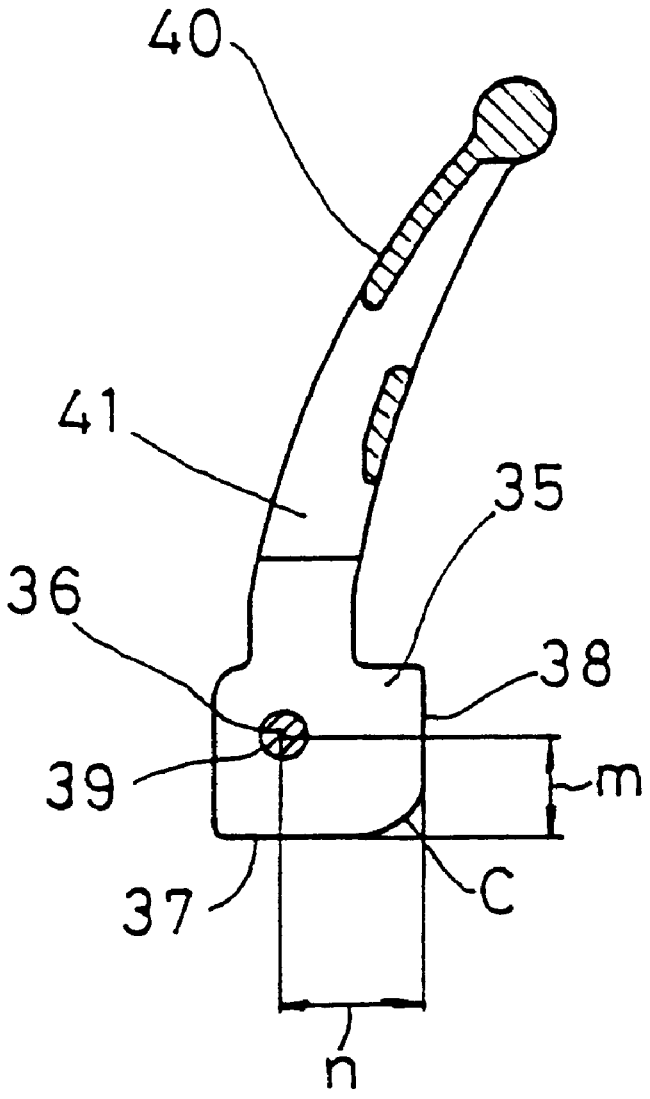
FIG. 3 is a partial cross section of the compressive force adjusting part and an operating lever of the high hat cymbal.

An axle hole 39 is formed in the compressive force adjusting part 35 for receiving the axle 36. FIG. 3 shows the two plate-like bodies with a plurality, two being shown, of compressing surface areas 37 and 38 which are at different distances or radii m and n, with m larger than n in this example, from the axles 36. The surface areas 37 and 38 contact and press upon the upper surface of the operating member 45. The surface areas 37 and 38 are flat surfaces, which are joined by a concavely curved surface C. This makes it possible to smoothly rotate the compressive force adjusting member 35 for modifying the cymbal tone color as described below.

An operating lever 40 rotates the compressive force adjusting part 35. It is formed integrally with the compressive force adjusting part 35. The lever 40 is slightly inclined with respect to a surface that opposes the first compressing surface area 37 of the compressive force adjusting part 35 and to the side of the second compressing surface area 38 of the part 35 as contrasted with directly crossing direction. There is also an opening 41 into the bottom side or the root of the operating lever 40 (on the side of the compressive force adjusting part 35), so that movement of the operating lever 40 is not obstructed by the installation rod R.

The functioning member 45 located under the upper cymbal fixing adjusting member 30 receives the compressive force of one of the compressing surface areas 37 and 38 of the upper cymbal fixing adjusting member 30. The member 45 comprises a tubular body or a disc having an opening 45*a* for receiving insertion of the rod R. As the installation rod R is inserted through the opening 45*a*, it is arranged under the upper cymbal fixing adjusting member 30.

The upper cymbal holding member 50 holds the upper cymbal 15. It has a tubular part 51 that is inserted into the installation hole 16 of the upper cymbal 15 to be arranged under the functioning member 45 when the installation rod R is inserted. The upper cymbal holding member 50 includes an annular flange 52 held integrally together with the tubular part 51 and the annular flange 52 contacts the lower surface of the functioning member 45.

As the tubular part 1 is inserted into the installation hole 16 of the upper cymbal 15 as described above, any possible deterioration of the installation hole 16 from the sliding of the upper cymbal 15 with respect to the installation rod R can be prevented. The member 50 has an opening 50*a* for insertion of the rod R.

The upper elastic member 55 buffers the compressive force applied by the upper cymbal holding member 50 and transmits the force to the upper cymbal 15. The member 55 is interposed between the upper cymbal 15 and the upper cymbal holding member 50. Felt may be used as the upper elastic member 55. However, rubber or foam or some other materials that have elasticity like a spring can be used like the lower elastic member 29. The member 55 has a hole 55*a* for insertion of the tubular portion 51 of the upper cymbal holding member 50 that is on the upper elastic member 55.

Figure 4:
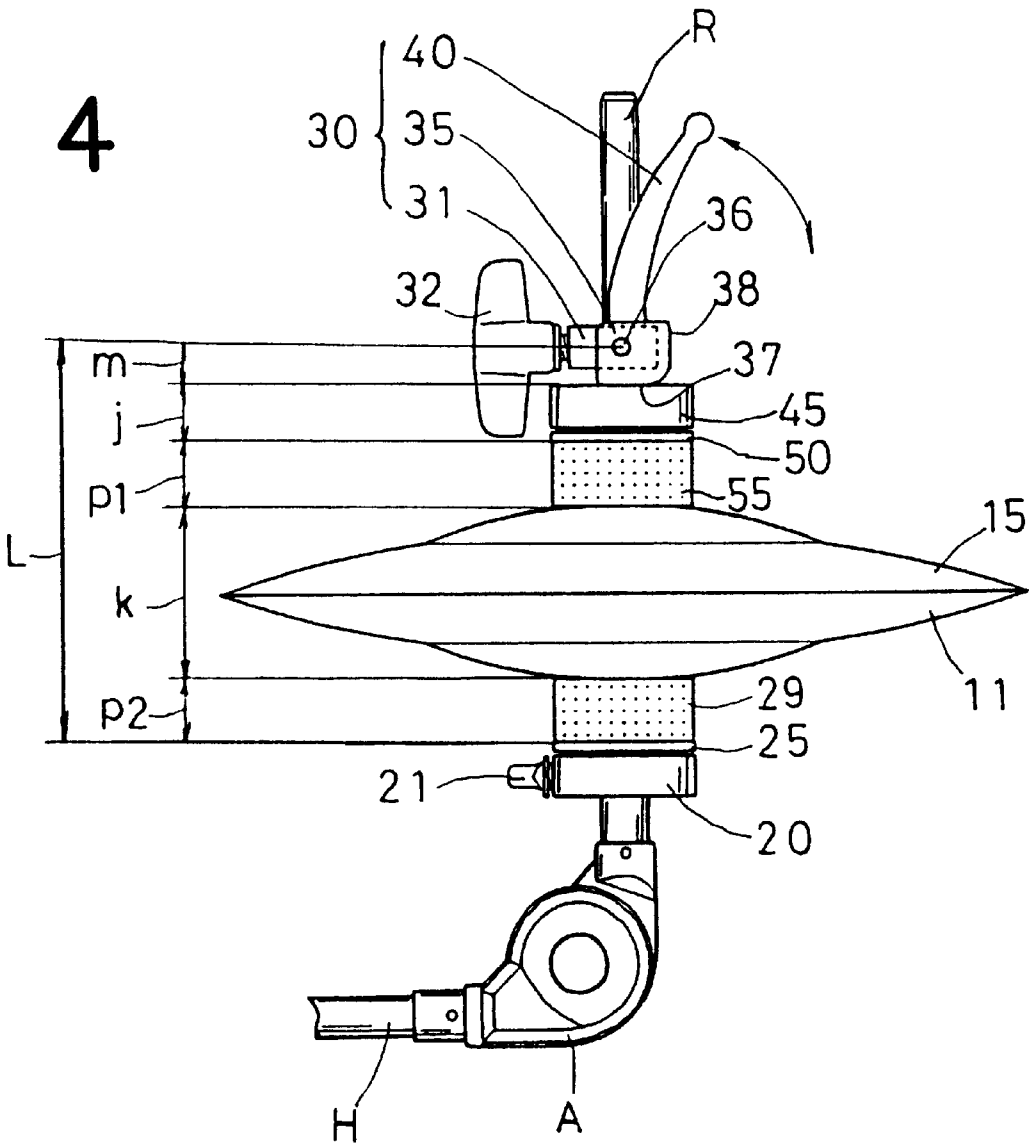
FIG. 4 is a partial front view showing the condition in which the lower cymbal and the upper cymbal in the high hat cymbal are loosely together.
Figure 5:
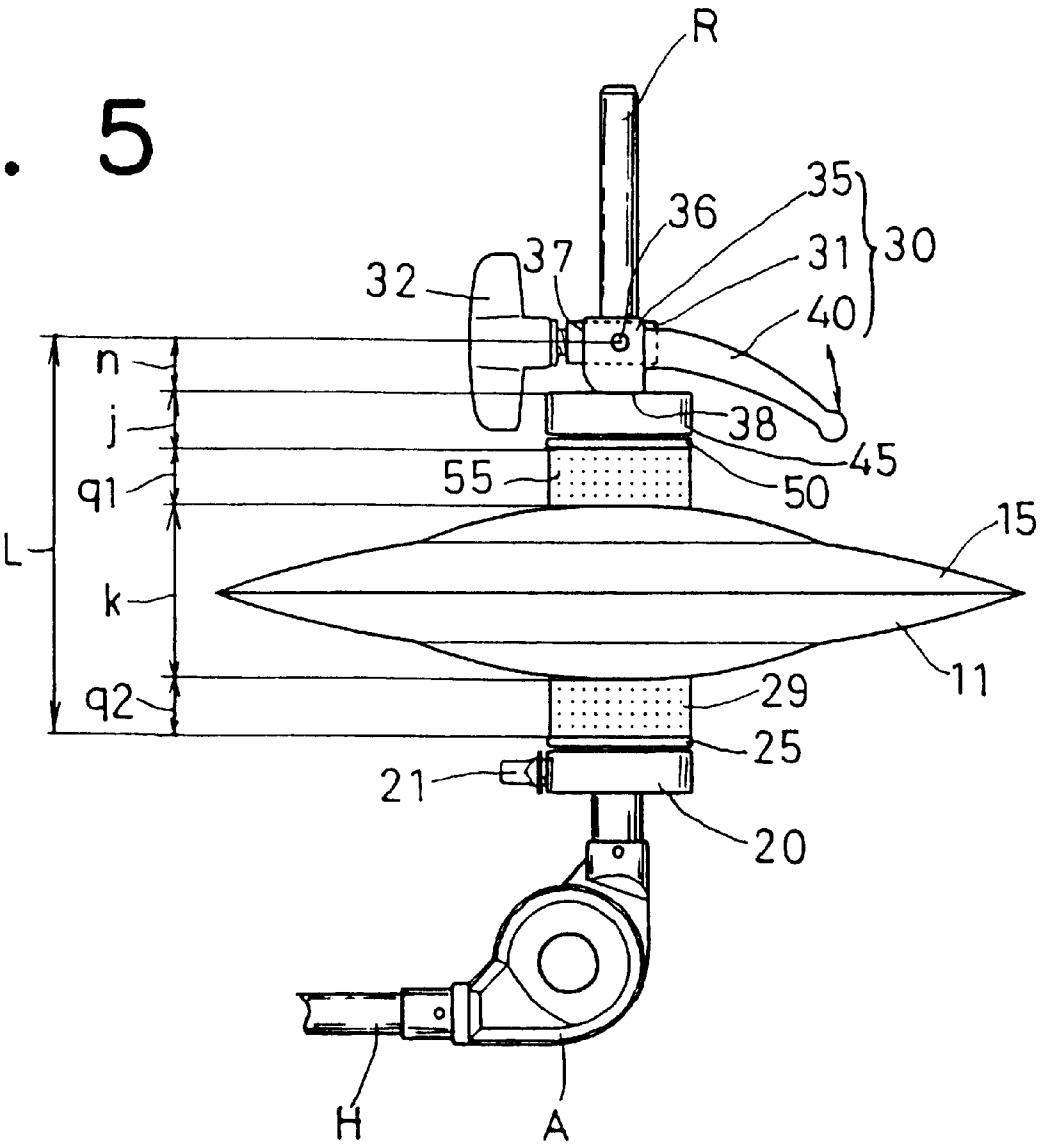
FIG. 5 is the same partial front view showing the condition in which the lower cymbal and the upper cymbal are firmly together.
Figure 6:
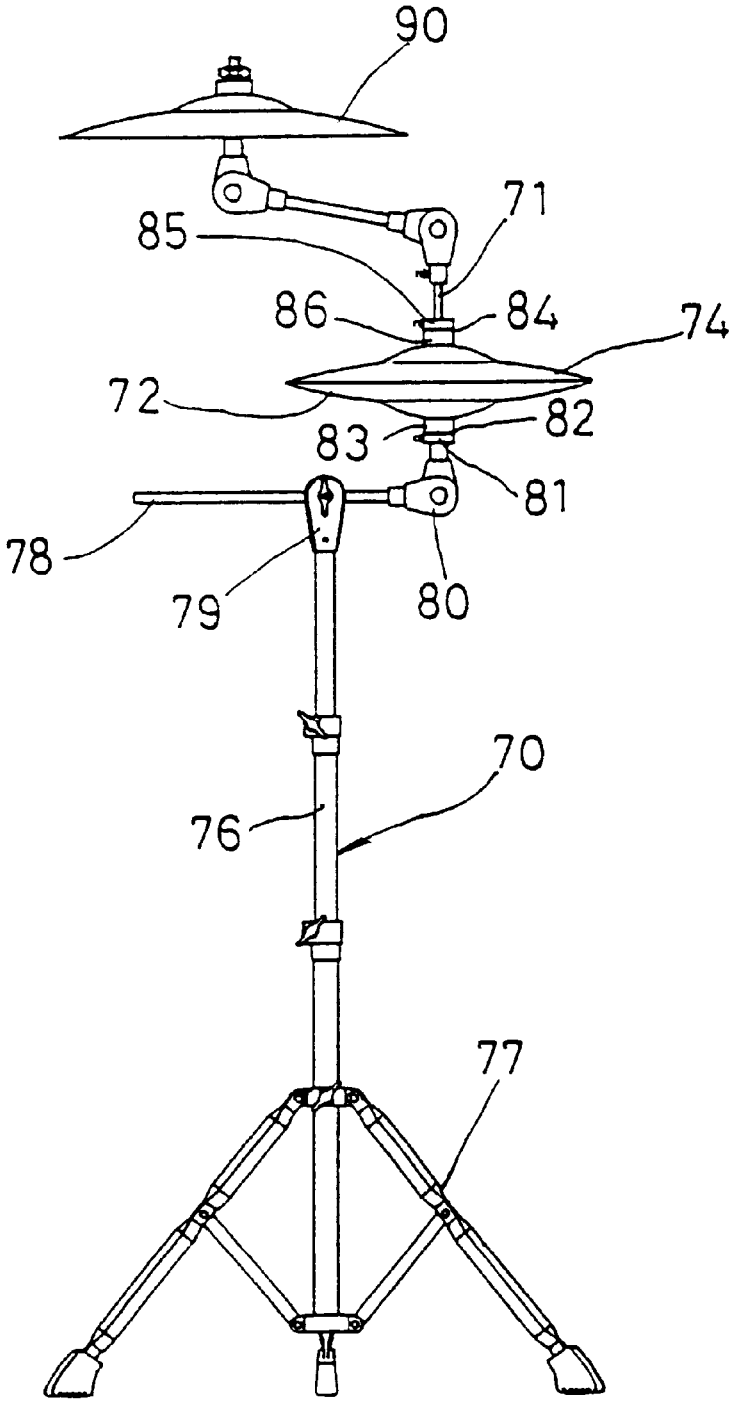
FIG. 6 PRIOR ART
FIG. 6 is a front view of an entire high hat cymbal according to a prior art embodiment.
Figure 7:
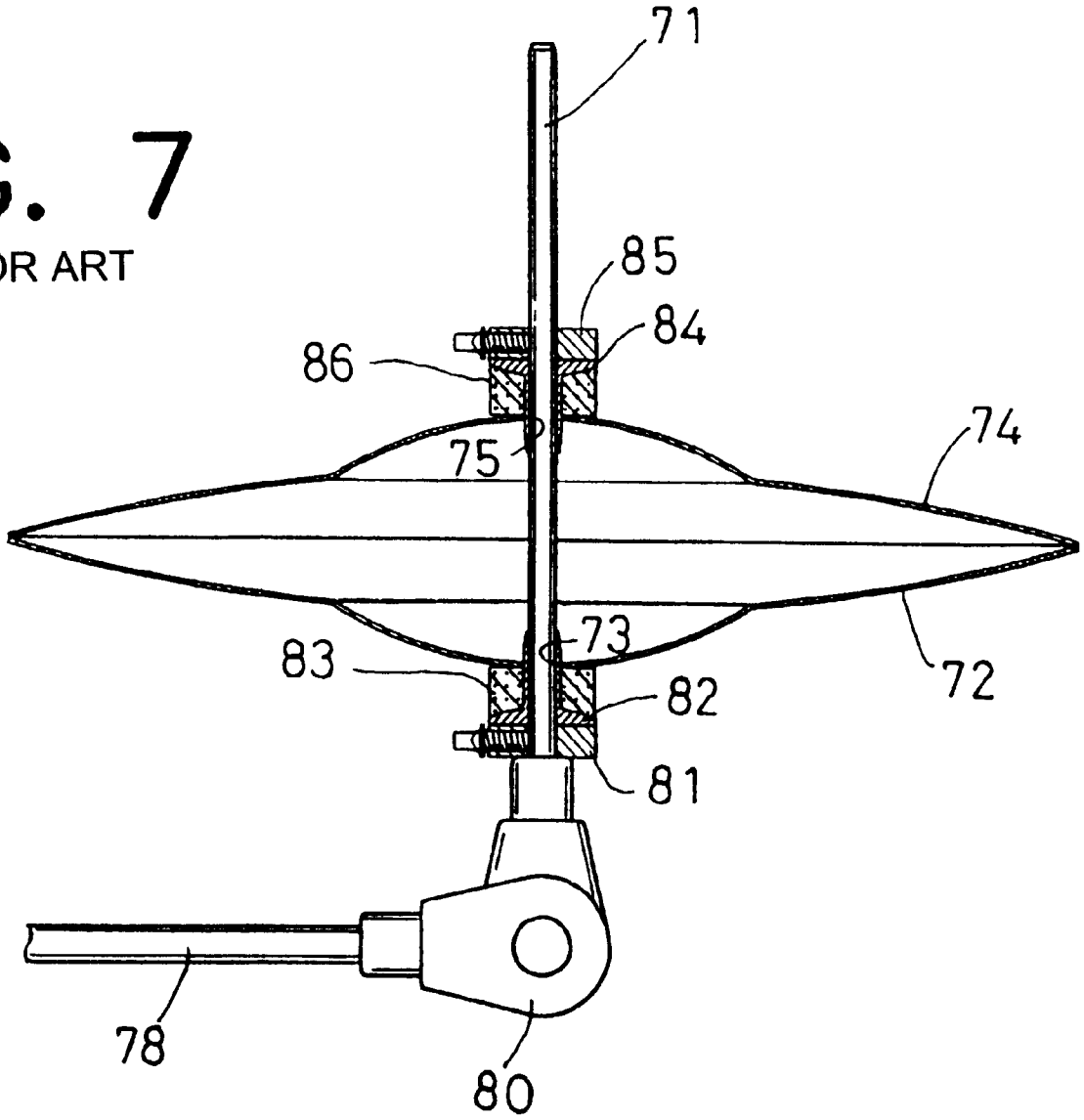
FIG. 7 PRIOR ART
FIG. 7 is a partial cross section showing the essential part of that prior art high hat cymbal.

Using the installation structure described, different tone colors are produced, with one tone color produced when the first compressing surface area 37 of the compressive force adjusting part 35 of the upper cymbal fixing adjustment member 30 is in contact with the functional member 45, as shown in FIG. 4, and with another tone color produced when the second compressing surface area 38 is in contact with the functional member 45, as shown in FIG. 5. This is explained below.

The distance L from the center of the axles 36 of the compressive force adjustment part 35 to the lower surface of the lower elastic member 29 is determined by the positions along the rod R of the upper cymbal fixing part 31 and the lower cymbal fixing member 20. After they are fixed on the installation rod R, the distance L becomes constant. In FIG. 4, this distance can be expressed by a first formula:

$$L=m+j+p1+k+p2$$

In the above first formula, m indicates the distance from the center of the axles 36 to the first compressive surface 37, j is the distance from the upper surface of the functional member 45 to the lower surface of the upper cymbal holding member 50, p1 is the thickness of the upper elastic member 55, k is the distance from the upper surface of the upper cymbal 15 to the lower surface of the lower cymbal 11, and p2 is the thickness of the lower elastic member 29.

In the condition of FIG. 5, the distance L can be expressed by a second formula:

$$L=n+j+q1+k+q2$$

In the above second formula, n indicates the distance form the center of the axles 36 of the compressive force adjustment part 35 to the second compressing surface area 38, j is the distance from the upper surface of the functional member 45 to the lower surface of the upper cymbal holding member 50, q1 is the thickness of the upper elastic member 55, k is the distance from the upper surface of the upper cymbal 15 to the lower surface of the lower cymbal 11, and q2 is the thickness of the lower elastic member 29.

The following relationship can be derived from the first and second formulas above:

$$[p1+p2]-[q1+q2]=n-m$$

The compressive force applied to the upper cymbal 15 and the lower cymbal 11 is inversely proportional to the thickness of the upper elastic member 55 and of the lower elastic member 29.

In FIG. 5, the upper elastic member 55 and the lower elastic member 29 contract or are compressed by the difference (n−m) in the radial distances between the compressing surface areas 37 and 38 and the axles 36, as described in the third formula, with the compressive force that is applied on the upper cymbal 15 and the lower cymbal 11 increasing and the adhesion between the upper cymbal 15 and the lower cymbal 11 becoming tighter. As a result, the tone colors differ between the positions shown in FIGS. 4 and 5.

Next, the method for switching the tone color during a performance is described.

The tone color can be modified during a performance quite easily by rotating the compressive force adjusting part 35 with respect to the upper cymbal fixing part 31 by operating the lever 40 of the upper cymbal fixing adjustment member 30 and changing the compressing surface area of the compressive force adjusting part 35 that is in contact with the upper surface of the functional member 45 from the first area 37 to the second area 38, or vice versa.

Two of the compressing surface areas of 37 and 38 of the compressive force adjustment part 35 are shown. However, the number of the compressive parts may be three or more, enabling production of three or more tone colors during a performance after installation of the high hat cymbals.

The installation structure of high hat cymbals can be extremely simple, the manufacturing cost can be reduced and the tone colors can be changed easily during a performance.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. An installation structure for a high hat cymbal for adjusting the compressive forces between upper and lower cymbals of the high hat cymbal, the installation structure comprising:

an installation rod;

an upper cymbal on the rod and a lower cymbal on the rod compressible against each other with different degrees of compressive force to adjust the tone color produced by the cymbals;

a lower cymbal fixing member fixed on the rod, a lower cymbal receiving member on the lower cymbal fixing member and also received on the rod;

a lower elastic member between the lower cymbal and the lower cymbal receiving member, the elastic member being compressible as pressure is applied thereto;

an upper cymbal adjustment arrangement comprising:

an upper cymbal fixing member fixed on the installation rod above the upper cymbal at a location along the rod selected so that the upper and lower cymbals are in engagement;

an upper cymbal functional member between the upper cymbal fixing member and the upper cymbal, the functional member being movable along the installation rod to and away from the upper cymbal;

an upper cymbal holding member disposed on the lower side of the upper cymbal functional member and between the upper cymbal functional member and the upper cymbal for supporting the upper cymbal;

an upper elastic member interposed between the upper cymbal and the upper cymbal holding member and which is compressible upon pressure being applied thereto; and a compressive force adjusting device supported to the upper cymbal fixing member and movable with respect to the upper cymbal fixing member and the installation rod to a plurality of different device positions, the compressive force adjusting device having a plurality of pressure applying surfaces thereon, each surface selectively engaging the functional member as the compressive force adjusting device is adjusted into a respective one of its plurality of device positions, and the compressive force adjusting device being shaped such that at each one of its plurality of device positions, the compressive force adjusting part moves the functional member to a respective member position along the installation rod and each of the member positions along the rod is different from the other member positions for thereby selectively compressing the upper elastic member to a greater or lesser extent, for applying selective different compressive force between the upper cymbal and the lower cymbal depending upon which one of the pressure applying surfaces is engaging the functional member.

2. The installation structure of claim 1, wherein all of the elements comprising the lower cymbal fixing member, the lower cymbal receiving member, the lower elastic member, the lower cymbal, the upper cymbal, the upper elastic member, the upper cymbal holding member, the functional member, the upper cymbal fixing member and the upper cymbal adjustment device are on the installation rod.

3. The installation structure of claim 2, wherein the installation rod extends through all of the elements on the rod.

4. The installation structure of claim 1, wherein the lower cymbal has a hole therethrough through which the installation rod passes, and the lower cymbal receiving member includes a tubular portion that extends into the hole in the lower cymbal;

the upper cymbal has a hole therethrough through which the installation rod passes, and the upper cymbal holding member has a tubular portion which is installed in the installation hole of the upper cymbal.

5. The installation structure of claim 1, wherein each elastic member comprises an annular piece of compressible elastic material.

6. The installation structure of claim 1, wherein the upper cymbal adjustment arrangement comprises a plate having an axis across the axis of the rod, a plurality of edge regions around the plate which are at different distances from the axis thereof;

the plate being pivotally supported to the upper cymbal fixing member at the plate axis and the plate being movable around the plate axis with respect to the upper cymbal fixing member for moving a selected one of the edge regions of the plate into engagement with the upper cymbal functional member to apply a respective selected force to the functional member and selective compressive force to the elastic members.

7. The installation structure of claim 6, further comprising a lever connected with the plate and operable for rotating the plate around the axle.

8. The installation structure of claim 7, wherein there are a pair of the plates symmetrically at opposite sides of the installation rod, and the upper cymbal functional member extending around the installation rod and beneath the plates of the upper cymbal adjustment arrangement.

* * * * *